US011346510B2

(12) United States Patent
Plissey

(10) Patent No.: US 11,346,510 B2
(45) Date of Patent: May 31, 2022

(54) DECORATIVE DISPLAY OF HOLLOW-CHAMBERED TRANSLUCENT PANELS AND LED STRIPS

(71) Applicant: Steven Plissey, Boulder, CO (US)

(72) Inventor: Steven Plissey, Boulder, CO (US)

( * ) Notice: Subject to any disclaimer, the term of this patent is extended or adjusted under 35 U.S.C. 154(b) by 0 days.

(21) Appl. No.: 17/492,570

(22) Filed: Oct. 2, 2021

(65) Prior Publication Data

US 2022/0120391 A1 Apr. 21, 2022

Related U.S. Application Data

(60) Provisional application No. 63/094,013, filed on Oct. 20, 2020.

(51) Int. Cl.

| | |
|---|---|
| ***F21S 4/10*** | (2016.01) |
| ***F21V 23/00*** | (2015.01) |
| ***F21W 121/04*** | (2006.01) |
| ***F21Y 115/10*** | (2016.01) |

(52) U.S. Cl.

CPC ..... *F21S 4/10* (2016.01); *F21V 23/001* (2013.01); *F21V 23/003* (2013.01); *F21W 2121/04* (2013.01); *F21Y 2115/10* (2016.08)

(58) Field of Classification Search

CPC ..... F21S 4/10; F21V 23/001; F21V 23/003
USPC ..... 362/311.13
See application file for complete search history.

(56) References Cited

U.S. PATENT DOCUMENTS

| | | | | |
|---|---|---|---|---|
| 4,068,118 | A | 1/1978 | Carrington | |
| 4,186,503 | A | 2/1980 | Fontana | |
| 4,364,102 | A | 12/1982 | Huppert et al. | |
| 4,428,988 | A | 1/1984 | Adinamis | |
| 4,578,291 | A | 3/1986 | Miner | |
| 4,858,086 | A | 8/1989 | Pietrantonio | |
| 5,057,981 | A | 10/1991 | Bowen et al. | |
| 6,031,958 | A * | 2/2000 | McGaffigan | G02B 6/0096 362/555 |
| 6,350,499 | B1 | 2/2002 | Babcock | |

(Continued)

FOREIGN PATENT DOCUMENTS

| | | |
|---|---|---|
| DE | 3420858 A1 | 1/2019 |
| GB | 949705 | 2/1964 |

OTHER PUBLICATIONS

Onlineledstore, 2pc 4ft Spiral LED Whip Lights for UTV ATV [21 Modes] [20 Colors] [RF Wireless Remote] [Weatherproof] [USA Flag] LED Lighted Whips Antenna for RZR Can-Am Polaris UTV ATV Accessories, printed on Mar. 10, 2022, published on Amazon website, USA (attached).

*Primary Examiner* — Bryon T Gyllstrom

(57) ABSTRACT

An assemblable display that can be arranged into different formations, including conical-like shapes suitable for exhibition as artificial Christmas trees. The display, which may be packaged as a kit, includes a center post, an LED strip lighting system, and a plurality of translucent panels with interiors that comprise one or more hollow chambers. The LED strips are affixed to the outer surface of the center post in a pattern configured to shine light in outward directions along a length of the center post. Each hollow-chambered panel includes a hole through which the panel is mounted over the center post and affixed LED strips. When the LED strips are illuminated, the display appears to glow in a broad spectrum of colors, brightness levels, and animated lighting effects.

20 Claims, 15 Drawing Sheets

(56) References Cited

U.S. PATENT DOCUMENTS

| | | | | |
|---|---|---|---|---|
| D624,452 | S | 9/2010 | Valenzuela | |
| 9,797,584 | B2 | 10/2017 | Andretta-Pulera | |
| 9,945,542 | B2 | 4/2018 | Evitt | |
| D832,133 | S | 10/2018 | Bach | |
| 10,136,748 | B1 | 11/2018 | Blunt | |
| 10,709,278 | B2 | 7/2020 | Ocegueda Gallaga et al. | |
| 10,711,962 | B2 | 7/2020 | Tannahill et al. | |
| 11,013,355 | B2 * | 5/2021 | Chen | F21V 23/06 |
| 11,244,558 | B2 * | 2/2022 | Altamura | F21V 23/003 |
| 2007/0253191 | A1 * | 11/2007 | Chin | A47G 33/06 362/123 |
| 2010/0053991 | A1 | 3/2010 | Boggs | |
| 2015/0164164 | A1 * | 6/2015 | Trotter | A47G 33/06 362/123 |
| 2015/0359066 | A1 * | 12/2015 | Loomis | H05B 45/20 362/123 |
| 2017/0248284 | A1 * | 8/2017 | Baldwin | F21S 4/15 |
| 2019/0313829 | A1 * | 10/2019 | Meger | A47G 33/08 |

* cited by examiner

DECORATIVE DISPLAY OF HOLLOW-CHAMBERED TRANSLUCENT PANELS AND LED STRIPS

BACKGROUND

Artificial trees are fixtures of the holiday season. Typically, they consist of a base, center pole, and synthetic branches. Once assembled, they are usually illuminated from sources located away from their core, often by strings of lights. Artificial trees tend to present static visages: single silhouettes; inanimate lighting schemes; and monochromatic branches. The typical artificial tree is bulky to store, not only because of its size, but also because of the many accessories required to adorn it, including light strings, garlands, and hanging ornaments. When it comes to manufacturing, artificial trees are expensive to fabricate because they require the use of sophisticated machinery and specialized materials.

Prior iterations of artificial trees have sought to address one or more limitations of typical designs. As will be seen, the display described below offers an extensive set of solutions in a single apparatus.

SUMMARY

This assemblable display can be arranged into different formations, including conical-like shapes suitable for exhibition as artificial Christmas trees. The central core of the display comprises a center post. The display's lighting system comprises one or more LED strips—hereinafter referred to in the plural as "LED strips" or "strips." The strips are affixed to the outer surface of the center post in a pattern configured to shine light in outward directions along a length of the center post. The display's synthetic branches comprise a plurality of narrow translucent panels. The interior of each such panel is hollow-chambered, comprising at least one cavity demarcated by one or more inner supports that are sandwiched between flat sheets. Each such panel also includes a hole through which the panel is mounted over the center post and the affixed LED strips. When the LED strips are illuminated, the assembled display appears to glow in a broad spectrum of colors, brightness levels, and light animations.

DESCRIPTION OF DRAWINGS

In the following detailed description, reference is made to the accompanying drawings and diagram that form a part hereof, and in which is shown by way of illustration specific illustrative embodiments. However, it is to be understood that other embodiments may be utilized, and that logical, mechanical, and electrical changes may be made. Furthermore, the method presented in the drawing figures, the diagram, and the specification is not to be construed as limiting the order in which the individual steps may be performed. The following detailed description is, therefore, not to be taken in a limiting sense.

In accordance with common practice, the various described features are not drawn to scale but are drawn to emphasize specific features relevant to the exemplary embodiments.

DETAILED DESCRIPTION

The display comprises three major elements: (1) a central core, which includes a center post that helps support the display in an upright position; (2) an LED lighting system, which delivers a wide array of colorful effects; and (3) a decorative assembly of hollow-chambered panels (hereinafter the "decorative panel assembly"), which diffuses light and facilitates the arrangement of the display into a variety of ornamental shapes. In the instance of taller displays, the center post can be segmented and joined together by various connectors, the particular design of which varies depending upon the segments' composition.

Figure 1:
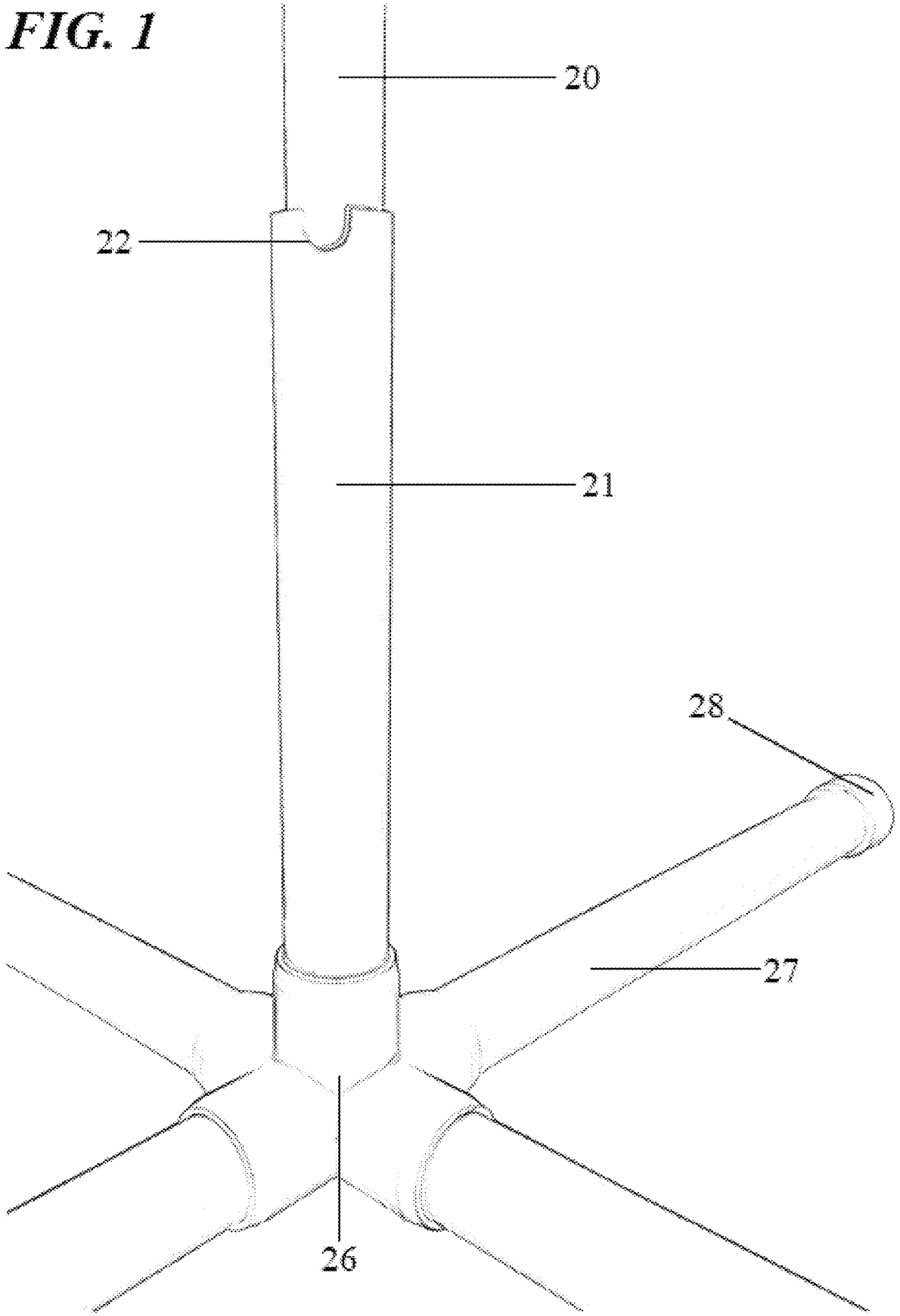
FIG. 1 shows an example central core of a decorative display.
Figure 2:
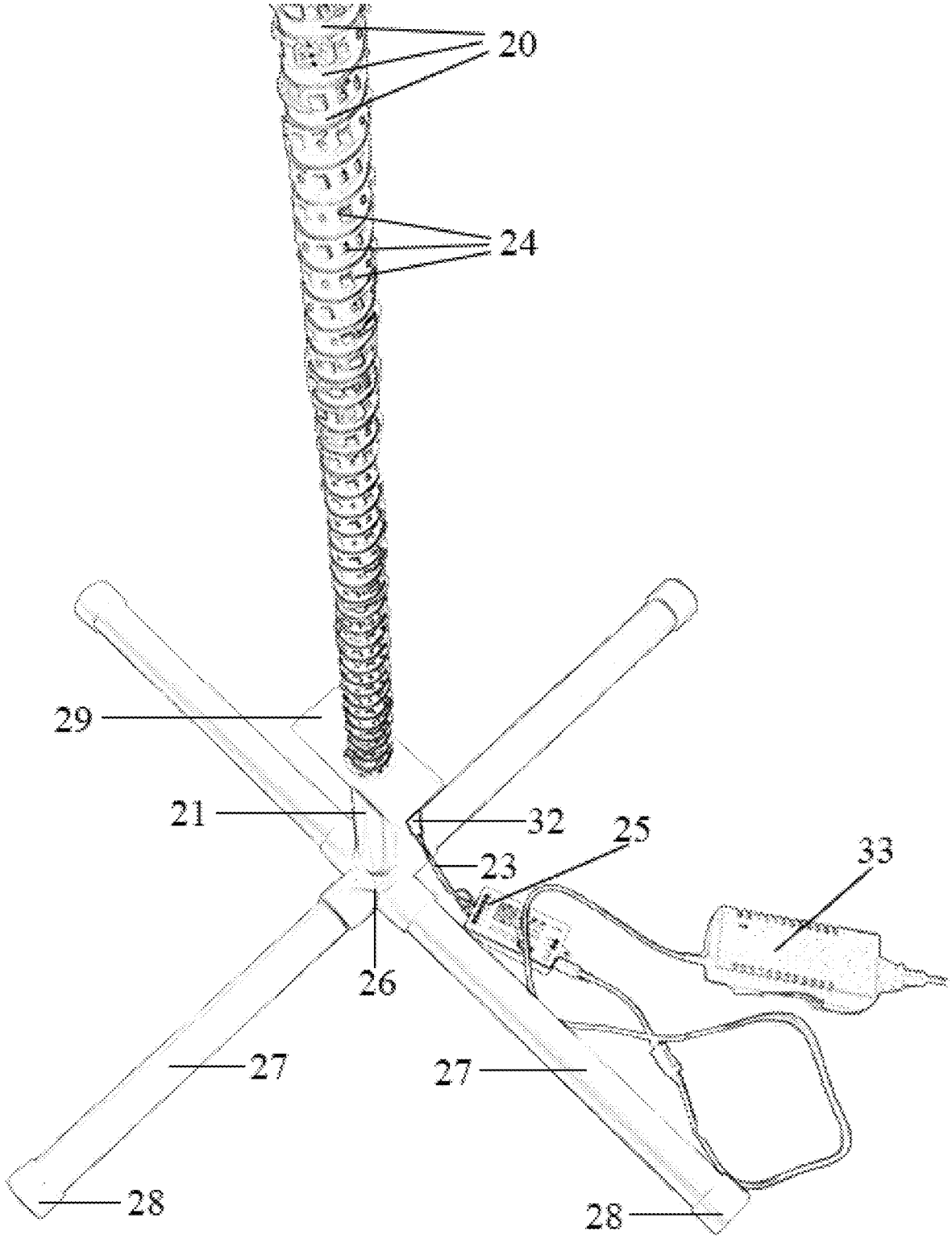
FIG. 2 shows an example central core of a decorative display with additional features.

As shown in the examples of FIGS. 1 and 2, the core of the display comprises a center post 20 made of lightweight hollow pipe or tube. In some examples, the lowest part of the center post is covered by a base sleeve 21 that is also made of lightweight hollow pipe or tube. The base sleeve 21 expands the circumference of the lowest part of the center post 20. The top of the base sleeve 21 forms a level rim. In some examples, a slot 22 cut through the rim of the base sleeve 21 is included. This aids the unimpeded transit of a set of wires 23 that connects the center post's LED strips 24 to an LED controller 25 that regulates LED colors, brightness levels, and animations.

In many instances, the center post 20 and base sleeve 21 will fit commercially available conventional Christmas tree stands, which helps make the display an economical choice for those who already own such equipment. In other instances, the display can be supported by a collapsible integrated base assembly, which can include a fitting with four or more sockets. In some examples, as is shown in FIGS. 1 and 2, the base assembly's centerpiece comprises five sockets 26. The top of the fitting hosts a receiving socket that accepts the base sleeve 21. The fitting also hosts four side sockets, each of which accepts a base leg 27 made of lightweight hollow pipe or tube. In some examples, each base leg 27 possesses an exposed outer tip that can be closed off with an end cap 28. The length of the base legs 27 varies in proportion to the height of the center post 20. This scaling ensures that the display, no matter its size, maintains a stable upright position. The depicted example of a base assembly is lightweight to ship and can be dismantled for compact storage.

The display is illuminated by LED strips 24 that when viewed in cross section consist of several layers. In some examples, the strips' bottom layer is comprised of double-sided adhesive tape. The upper layers can include such items as flexible printed circuit boards, diodes, resistors, addressable chips, and silicone weatherproofing. Although LED strips 24 are likely to improve as lighting technologies develop, the display's modularity mitigates against any risks of obsolescence. For example, consumers can upgrade to the latest LED strips 24 by buying a new center post 20 instead of repurchasing a full display.

In the instance shown in FIGS. 1 and 2, the LED strips 24 adhere to the outer surface of the center post 20 in an upward spiral that begins at the base sleeve slot 22 and finishes below the center post's apex. The use of a spiral offers several advantages. First, it effectively distributes 360 degrees of illumination along the center post's length. Second, the space between each spiral helps to dissipate any heat created by components of the LED strips 24. Third, the spiral pattern maintains an uninterrupted sequence of LEDs aligned in a single direction—an arrangement that allows for the straightforward rendering of light animations. Fourth, in instances where the display is arranged as stylized spiral, see FIG. 5, the spiral LED pattern intensifies light animations. For example, at slower speeds of animation, light appears to spin outward from the display's core to its outermost edges. Fifth, the spiral pattern permits the modulation of light intensity along the length of the center post 20. Basically, the more spirals that are wrapped around a linear span of center post 20, the higher the luminosity. At the bottom of the post, where the hollow-chambered panels are typically longer, the spirals can be densely wrapped to deliver greater luminosity. At the top of the post, where the hollow-chambered panels are typically shorter, the spirals can be spaced further apart.

As shown in the example depicted in FIGS. 1 and 2, the lowest point of the affixed LED strips 24 is located at the base sleeve slot 22. From this point downwards, the LED strips 24 connect to a set of unaffixed wires 23. Each wire within the set performs a function relating to the operation of the LED strips 24 such as data in, ground, power, or other operational function. After exiting the base sleeve slot 22, the set of wires terminates in a male/female plug 32. This plug inserts into a corresponding plug 32 attached to a matching set of wires 23 that leads to an LED controller 25, which in some instances can be a commercially available controller or in other instances can consist of a specially programmed controller that enables special lighting effects, including but not limited to a compact single-board computer or microprocessor. The LED controller 25 receives instructions from one or more wired or wireless signaling devices (including but not limited to remote controls, switches, phone apps, or music synchronizers). In some instances, a wired signaling device can be positioned within various elements of the display, including but not limited to the center post 20, the base sleeve 21, commercially available Christmas tree stands, or an integrated base assembly. The LED controller 25, and, in some instances, the wired signaling device, connect to a cord attached to a plug that fits into a power source, which depending upon the LED strips' 24 requirements can be either an alternating current (AC) wall outlet or a direct current (DC) power supply 33. In instances involving a DC power supply 33, the supply connects to a cord with a plug that connects to an AC wall outlet. In some instances, the wired signaling device can be installed in the connective wires at a suitable point between the exterior of the center post and the power source. An on-off switch can be installed in the cord at a suitable point between the AC wall outlet and DC power supply 33 or, in instances where no DC power supply 33 is present, between the AC wall outlet and LED controller 25. It should be understood that in some instances, more than one DC power supply 33 can be used to provide electricity to various components of the LED lighting system. It should be understood that the plugs connecting to or from the LED controller 25 and/or DC power supply 33 can be any suitable type of plug or the like, such as, for example, barrel plugs, 3-pin plugs, 4-pin plugs, bullet connectors, or the like, or combinations thereof.

Figure 3:
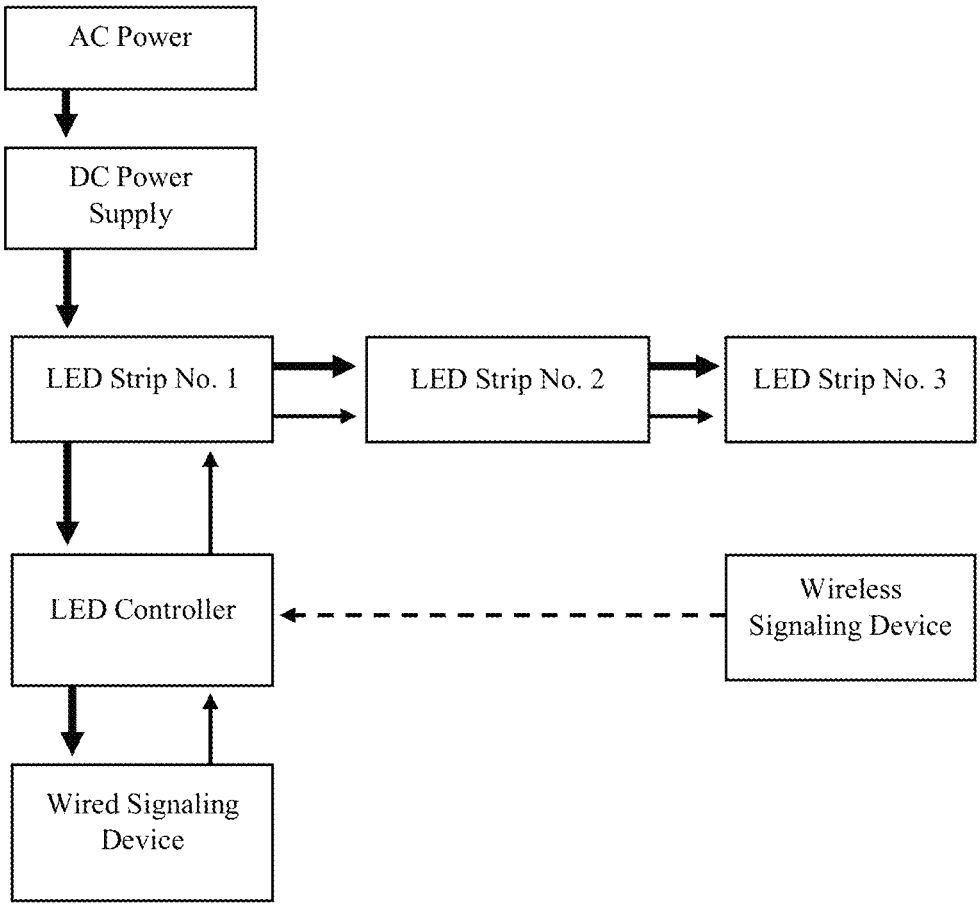
FIG. 3 is a diagram illustrating an example LED lighting system for a decorative display.

The diagram in FIG. 3 depicts one example LED lighting system for supplying electrical power and data to the decorative display. In the example shown, the flow of electrical power, indicated by the thicker line with an arrow, originates from an AC power source that connects by wires to a DC power supply. The DC power supply connects by wires to a first LED strip (labeled "LED Strip No. 1"), which in turn connects by wires to a second LED strip, which in turn connects by wires to a third and, in this instance, final LED strip. In the example of FIG. 3, the electrical power also flows via wires from the first LED strip to an LED controller, which governs the presentation of LED color palettes, brightness levels, and light animations. The LED controller relays DC power to a wired signaling device. The wired signaling device sends instructions, indicated by the thinner line with an arrow, to the LED controller which relays data via wire to LED Strip No. 1. The data then travels by wire from LED Strip No. 1 to the other LED strips. In the example depicted, the illumination of the LEDs can also be adjusted via a wireless signaling device (in FIG. 3 wirelessly transmitted instructions are indicated by a dashed line with an arrow). The wireless signaling device can use Wi-Fi, Bluetooth, or any other wireless technology standard. In other examples, data can be transmitted wirelessly from the LED controller to one or more of the LED strips. In other examples, the DC power supply can connect to an LED controller which via wires transmits power and data to a series of LED strips.

Figure 4:
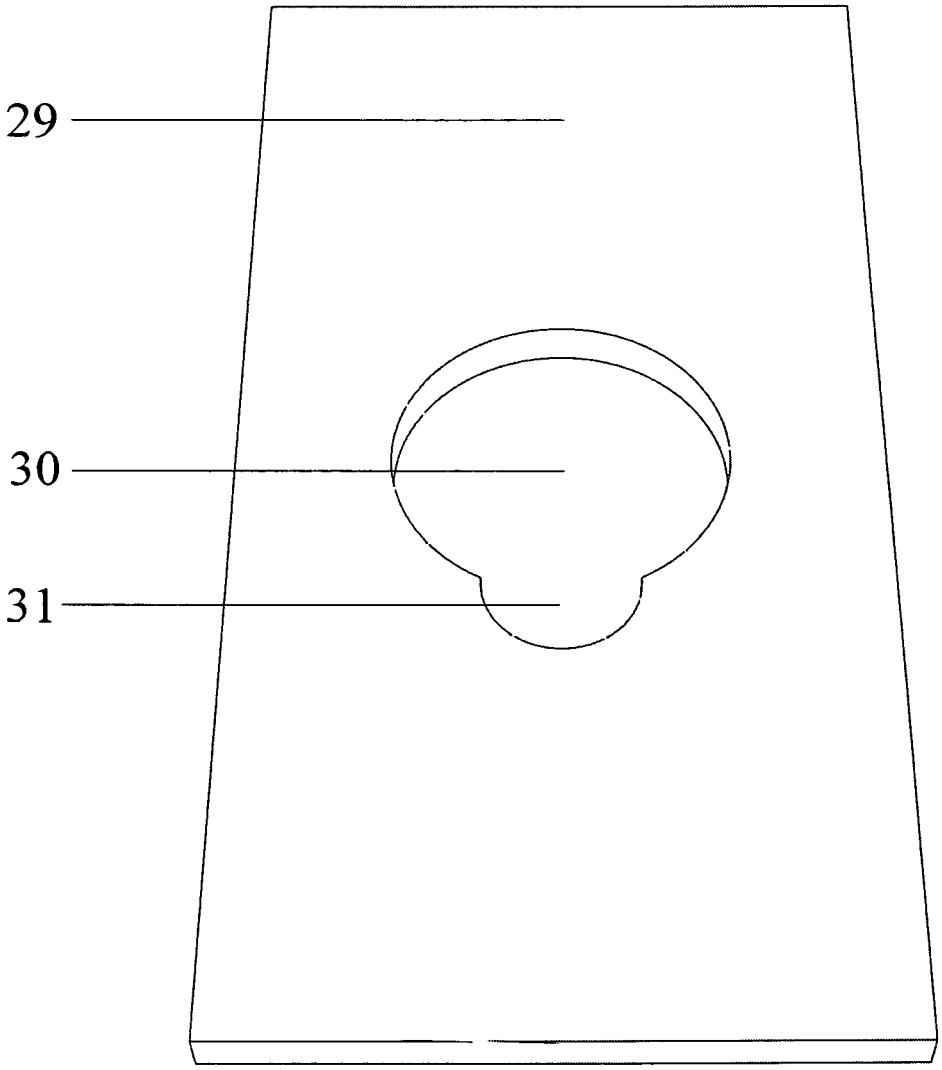
FIG. 4 shows an example platform for a decorative display.

The LED strips 24 beam light into a decorative panel assembly 36. As shown in the example depicted in FIG. 4, in some instances the foundation of the decorative panel assembly 36 can comprise a platform 29 that consists of a short rectangular piece of solid or hollow-chambered material that is capable of light transmission. The platform 29 can be either clear or frosted. In some examples, the platform's width is equal to or less than the width of the bottommost hollow-chambered panel and is approximately the same thickness. A circular hole 30 in the middle of the platform 29 is wide enough to fit over the LED strips 24 affixed to the center post 20, but not wide enough to slip over the top of the base sleeve 21. In some examples, a small half circle hole 31 can be cut into the side of the platform's hole 30 and placed over the similar sized slot 22 located at the top rim of the base sleeve 21. In combination, the slot 22 and half-circle hole 31 permit the pinch-free transit of wires 23 from the LED strips 24 to the LED controller 25. It should be understood that different shaped slots and holes can also be used in other examples. As installed, the platform 29 perches on the rim of the base sleeve 21 to help carry the weight of the decorative panel assembly 36. The platform 29 also transmits light from the lowest LEDs located on the LED strips 24 to the lowest parts of the decorative panel assembly 36.

Figure 5:
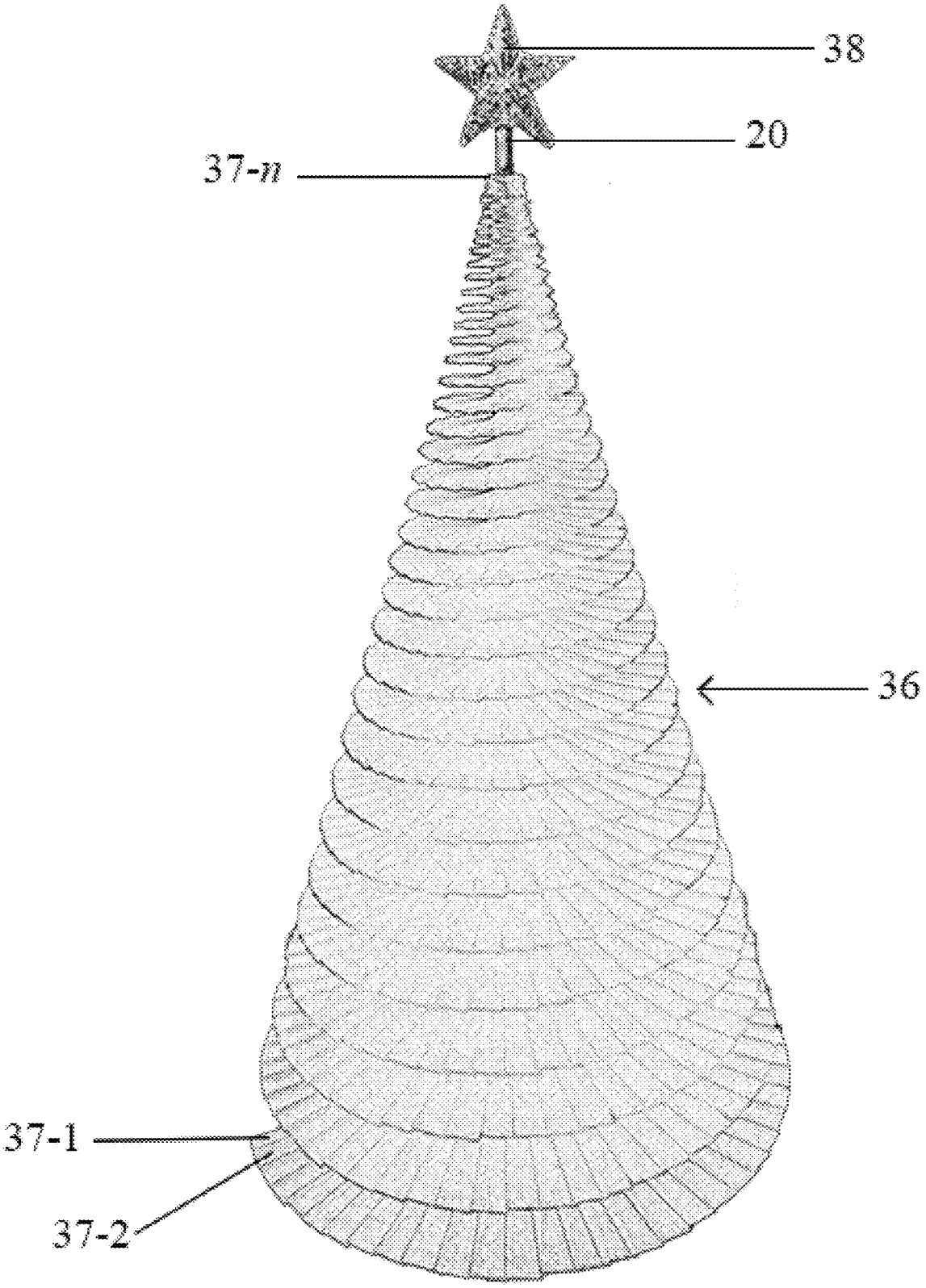
FIG. 5 shows an example decorative display assembled into the shape of a stylized spiral.

One instance of an assembled display is shown in FIG. 5. As the display's outer layer, the decorative panel assembly 36 overlays the LED strips 24 affixed to the center post 20. This assembly comprises translucent hollow-chambered panels **37-1-37-*n* each of successively diminishing length and each mounted over the center post 20 and affixed LED strips 24. The hollow-chambered panels 37-1-37-*n* make up the display's synthetic branches and diffuse the light that is transmitted outwards from the center post 20 when the LED strips 24 are illuminated. As the illuminated LEDs change colors, the hollow-chambered panels appear to change colors as well. This ability to change colors greatly boosts the display's versatility. Not only can the decorative panel assembly 36** show Christmas-themed colors such as red and green, it can show colors for other holidays as well: pinks and reds for Valentine's Day; verdant shades for St. Patrick's Day; colors of the USA flag for Independence Day; oranges and yellows for Halloween, etc.

In some examples, as shown in FIGS. 5 through 8, each hollow-chambered panel **37-1-37-*n* is fabricated of translucent, hollow-chambered corrugated plastic. Lightweight and inexpensive, corrugated plastic in its most common twin-wall form is a flexible material that comprises two outer flat sheets (also called facings) separated by regularly spaced inner supports. These inner supports, generally known as flutes or ribs, can be manufactured in various configurations, including but not limited to "I," "S," "X," and "conical" flutes. When corrugated sheets are cut into individual narrow panels, the flutes located nearest to the panels' sides and tips are exposed to view. Moreover, the outline of flute edges is conspicuously visible as white lines beneath the panel's translucent facings. In instances where interior of the corrugated plastic is composed of "I" flutes, parallel white lines appear to radiate outward from the center post 20**, thus imparting to the display a distinctive starburst effect.

In some instances, each hollow-chambered panel **37-1-37-*n* can be constructed to include fewer inner supports than are typically present in panels made of corrugated plastic. In some examples, each individual hollow-chambered panel 37-1-37-*n* can comprise a single inner cavity with inner supports that line at least a portion of the panel's perimeter and, in some instances, also line at least a portion of the panel's hole 35. In some instances, the interior of each hollow-chambered panel 37-1-37-*n* can comprise one or more additional layers of flat sheets positioned between and parallel to the two flat sheets located on the panel's exterior. In the case of corrugated plastic, examples of this particular configuration are generally known as tri-wall or triple wall corrugated plastic. In some instances, frosted patterns can be imprinted upon the outer sheets of one or more hollow-chambered panels 34. In some instances, one or more hollow-chambered panels 37-1-37-*n*** can include glitter or other reflective particles bonded to one or more of its outer sheets and/or added to its ingredients during the manufacturing process.

Despite its synthetic composition, the decorative panel assembly 36 echoes nature. At longer lengths, the hollow-chambered panels exhibit a pronounced drooping that resembles the downward bend of evergreen branches. This imparts to the display a curvy flourish. Moreover, in some examples the longer hollow-chambered panels can be made wider than the shorter hollow-chambered panels. In such an instance, when the display assumes an upright conical shape the widths of the hollow-chambered panels will decrease as they ascend the center post 20, much like real-life branches taper off at treetops.

Figure 6:
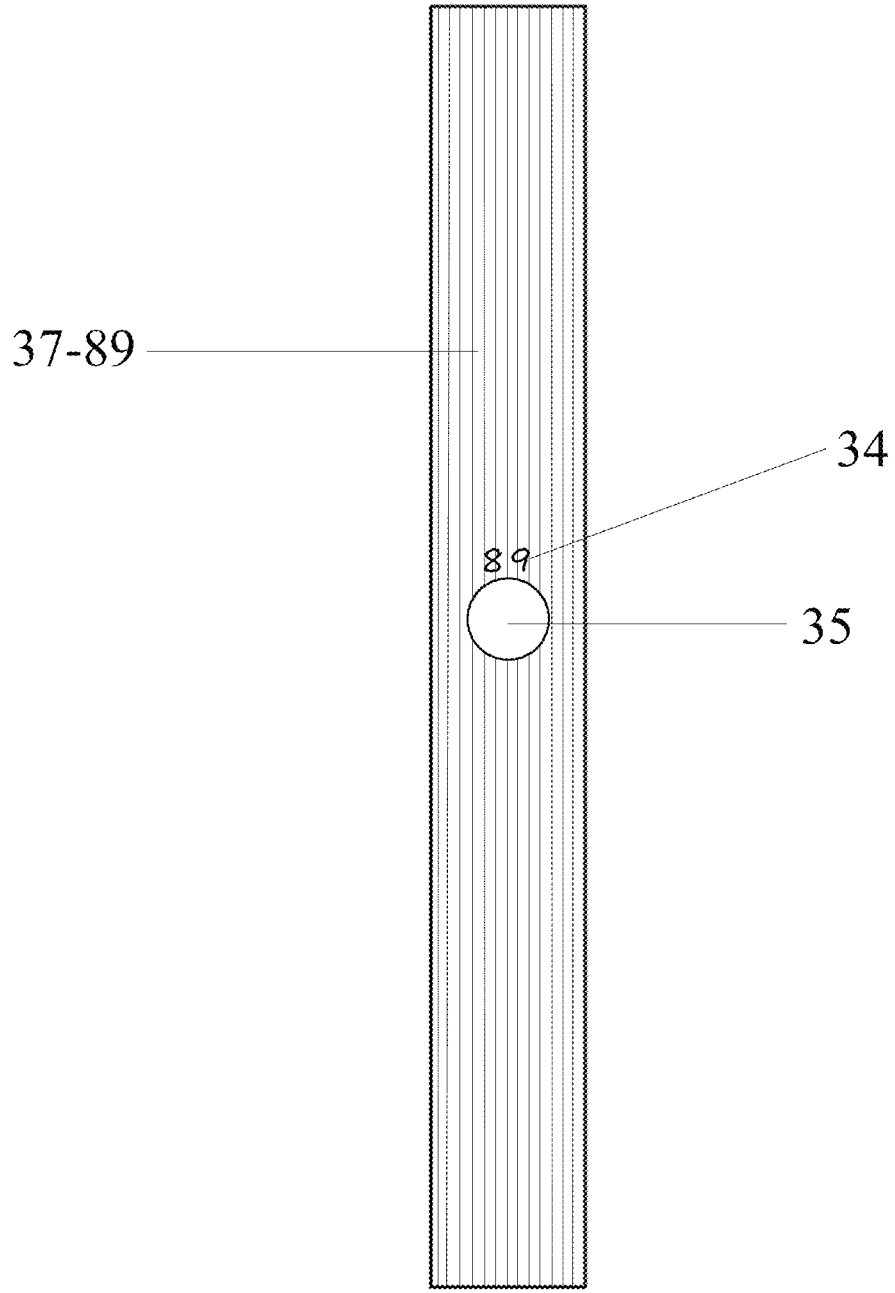
FIG. 6 shows an example top view of a hollow-chambered panel.
Figure 7:
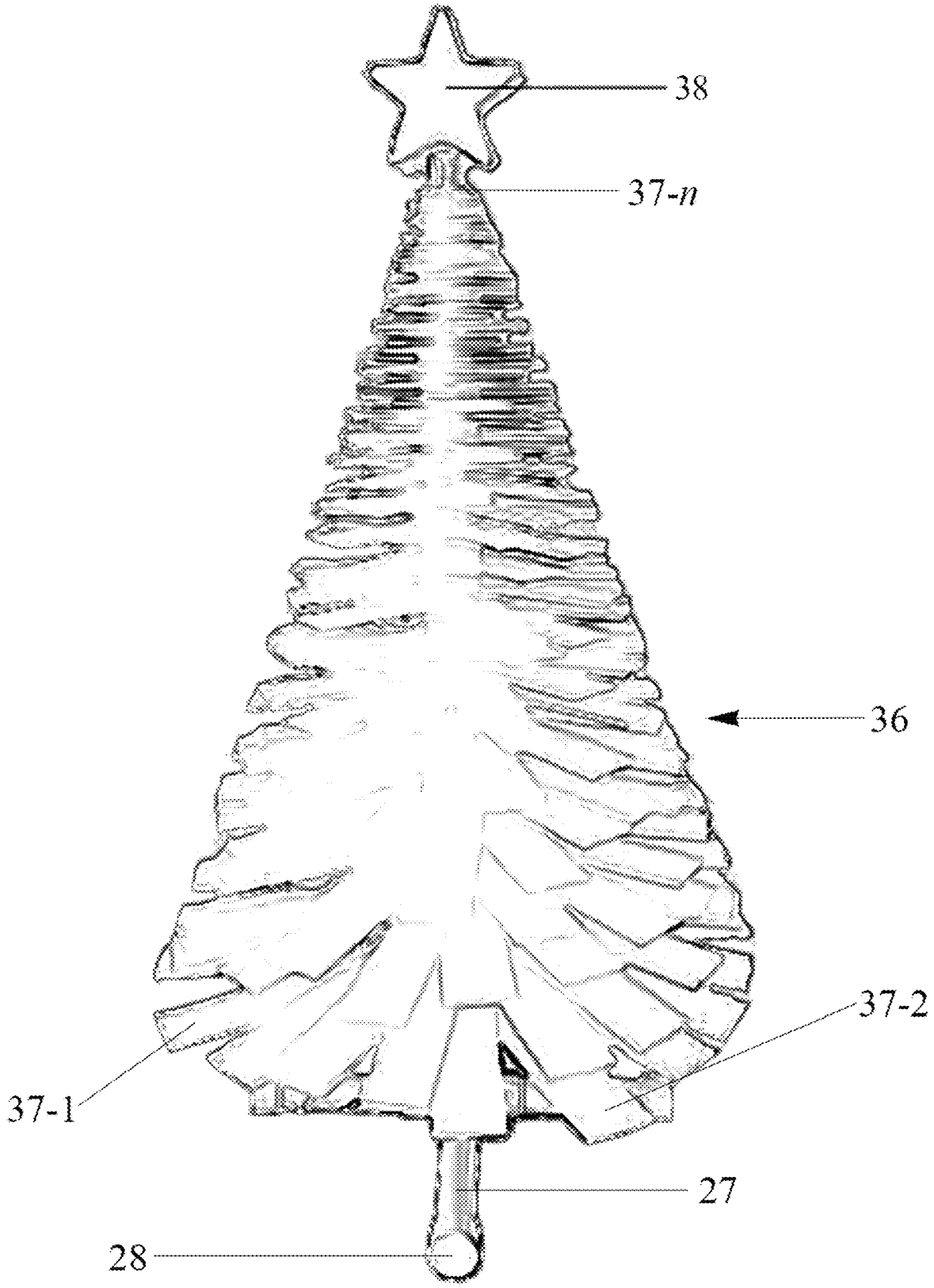
FIG. 7 shows a tabletop version of an example decorative display assembled into the shape of a pine tree.
Figure 8:
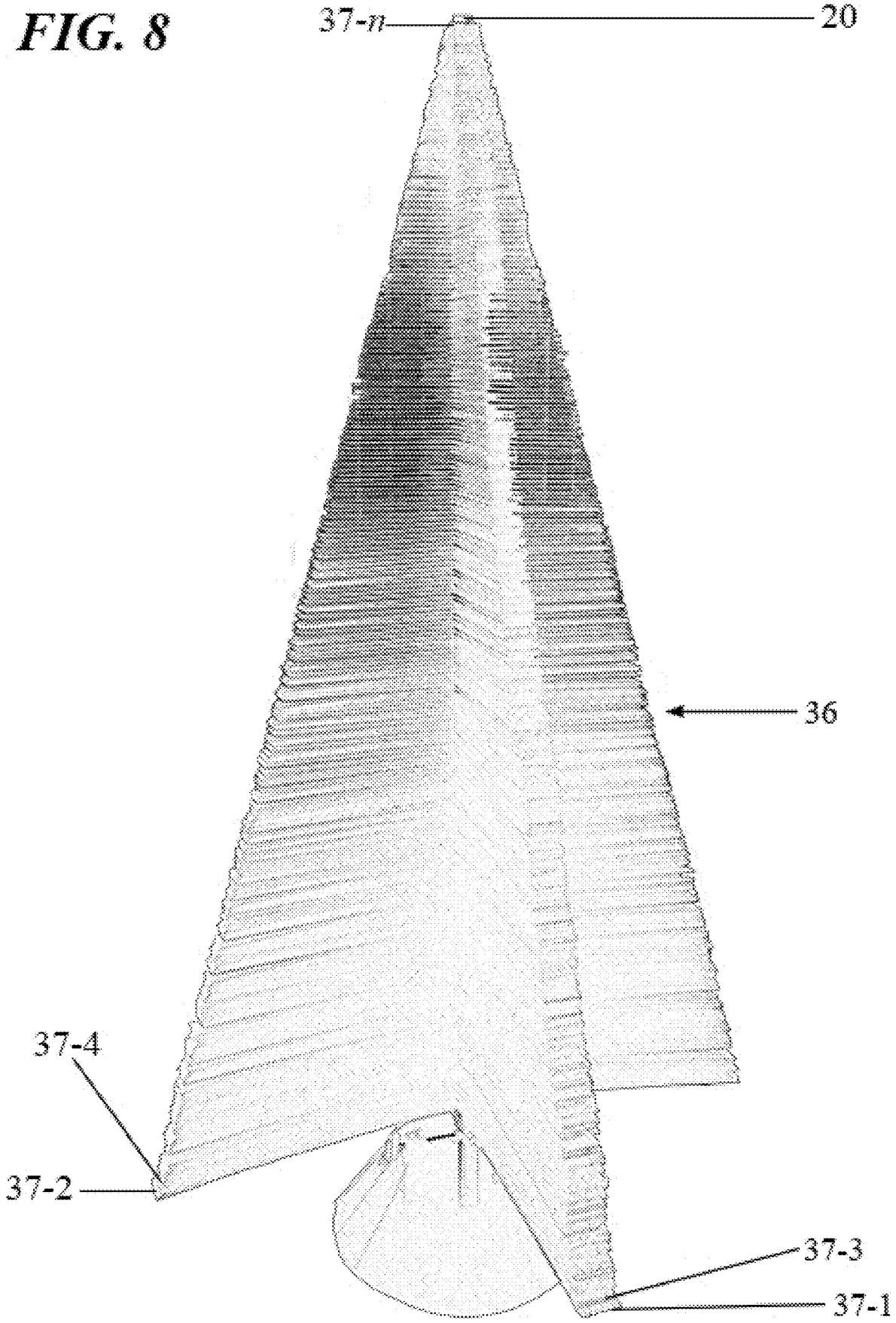
FIG. 8 shows an example decorative display assembled into a pyramidal shape with four deeply inverted corners.
Figure 9:
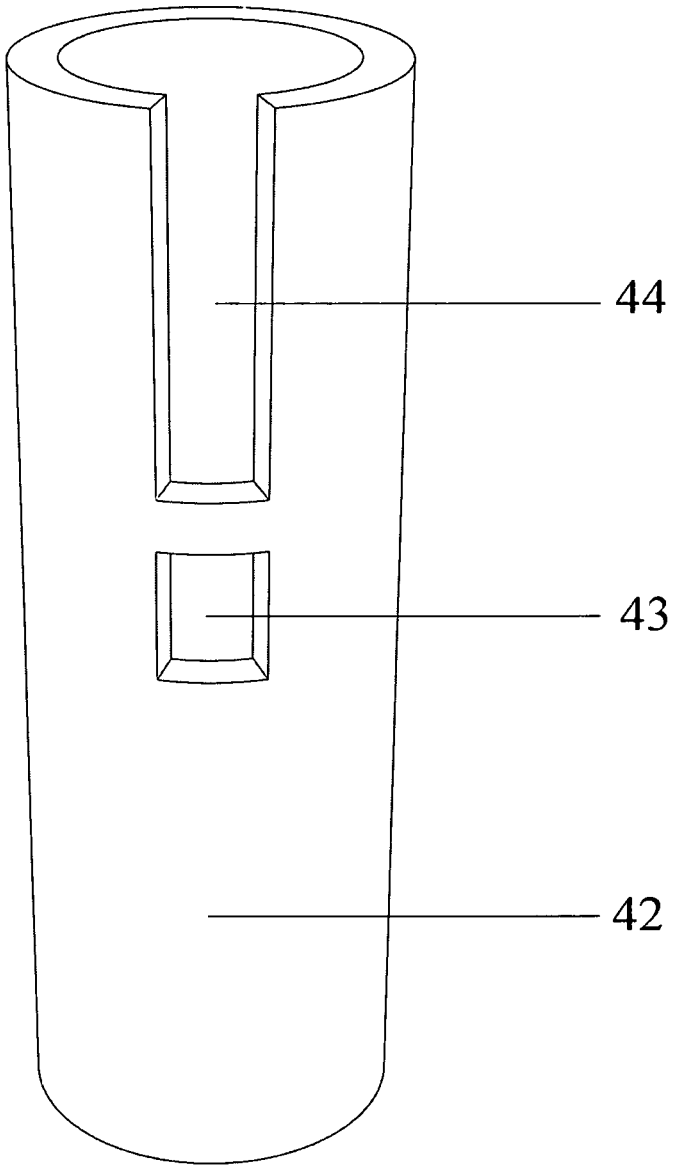
FIG. 9 shows an example internal coupling for a decorative display.
Figure 10:
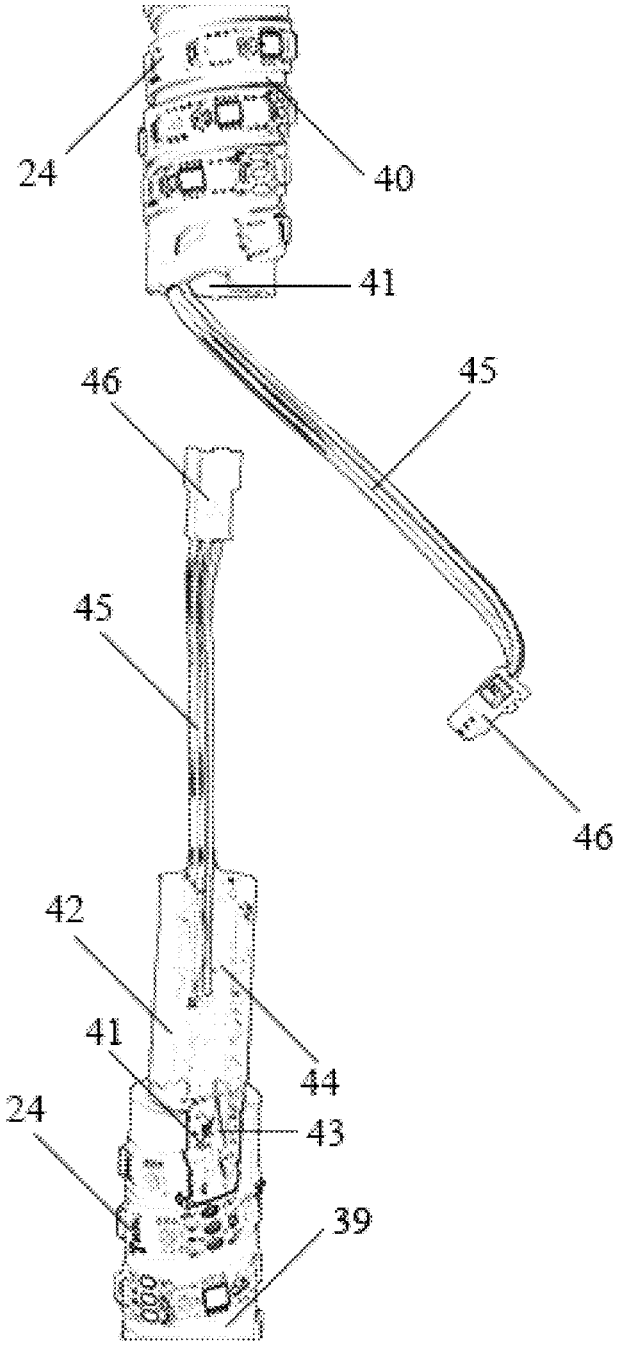
FIG. 10 shows an example internal coupling as installed in a lower segment of a decorative display with the lower and upper segments detached.
Figure 11:
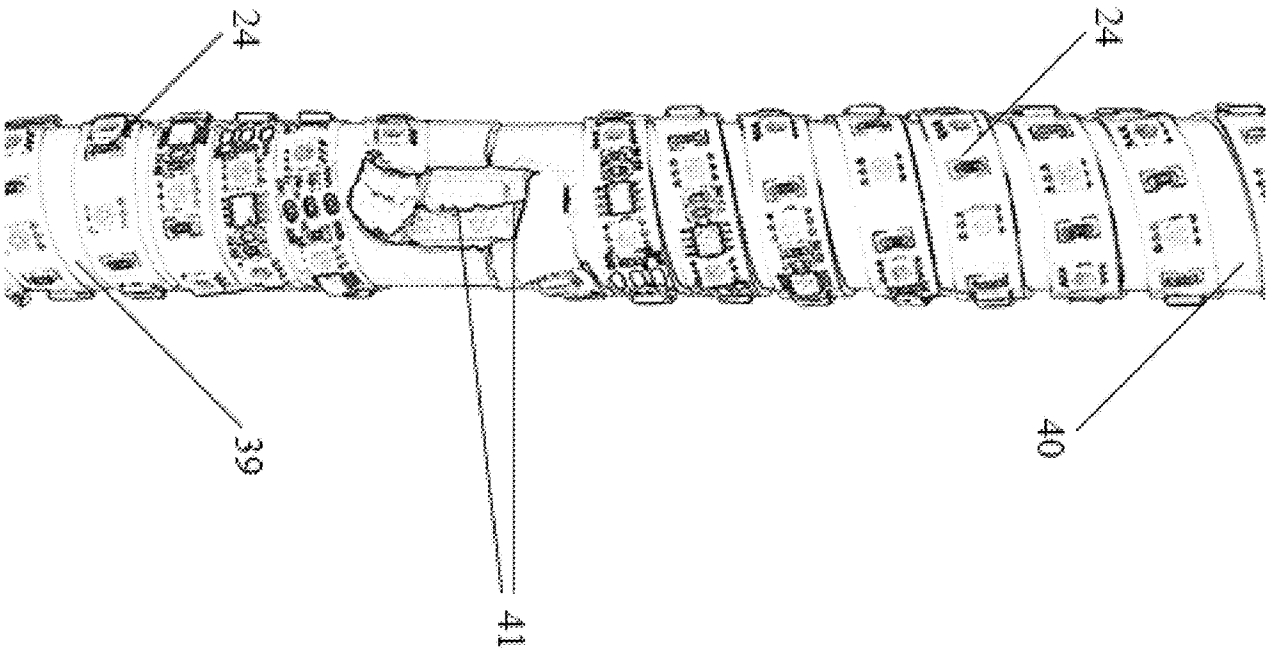
FIG. 11 shows an example internal coupling of a decorative display with the lower and upper segments attached.

A specific instance of one hollow-chambered panel 37-89 is shown in FIG. 6. Each hollow-chambered panel includes a hole 35 wide enough to permit its mounting over the LED strips 24 affixed to center post 20. It should be understood that a different shape for the hole 35 can also be used in other examples. Once mounted and with its middle supported by either the platform 29 or another hollow-chambered panel located immediately below it, each panel can be laterally swiveled to any point 360 degrees around the axis of the center post 20. This maneuverability allows users to quickly arrange the display into a wide variety of different shapes. Each hollow-chambered panel **37-1-37-*n*** in the display can be conveniently contained within a compact flat pack box. The use of such boxes not only cuts freight costs but also slashes manufacturer outlays for cardboard and warehouse space.

To assist in the arrangement of particular ornamental formations, as shown in FIG. 6 in some examples the hollow-chambered panels on one or more outer surfaces can comprise imprinted ordinal numbers 34 that signify the length of each panel relative to other panels of the decorative panel assembly 36. In some instances, these ordinal numbers 34 can be located near the hole 35 of each hollow-chambered panel beginning with the panel of the longest length 37-1 and ending with the panel of the shortest length **37-*n*. Using instructions that reference these ordinal numbers 34, users can arrange the decorative panel assembly 36** into a variety of different assemblages:

Stylized Spirals. To assemble the formation shown in FIG. 5, users slide the longest panel, 37-1, down the center post until it rests on top of and parallel with the platform 29. Next, users slide the second longest panel, 37-2, down the center post and place the panel's outer left edge so that it barely overlaps the right outer edge of the first panel 37-1. This process is repeated until the shortest hollow-chambered panel **37-*n*** is placed. If necessary, individual hollow-chambered panels can be swiveled to the left or right to close any gaps.

Pine Trees. To assemble the formation shown in FIG. 7, users slide the longest hollow-chambered panel, 37-1, down the center post until it rests on top of and parallel with the platform 29. Next, users slide the second longest panel, 37-2, down the center post and place it on top of Panel 37-1 at a 90-degree angle. When viewed from above, the pair of hollow-chambered panels forms a cross. Users then stack pairs of ordinally numbered hollow-chambered panels to create other 90-degree crosses, making sure that each newly added cross is positioned in such a way that limits any overlap with the cross immediately below it. Through this repeated layering, the display eventually assumes a conical shape that resembles a pine tree. Once the shortest hollow-chambered panel **37-*n*** has been positioned, individual hollow-chambered panels can be swiveled as needed to close any gaps and thereby provide the fullest showing of branches.

Pyramidal Structures with Inverted Corners. To assemble the formation shown in FIG. 8, users slide the longest panel, 37-1, down the center post until it rests on top of and parallel with the platform 29. Next, users slide the second longest panel, 37-2, down the center post and place it on top of panel 37-1 at a 90-degree angle. When viewed from above, the pair of hollow-chambered panels forms a cross. Users then slide panel 37-3 down the center post until it is aligned precisely above panel 37-1. Panel 37-4 is slid down the center post until it is precisely aligned above panel 37-2. Repeating this pattern for the remaining hollow-chambered panels results in the odd-numbered panels being stacked in a straight column of receding length and, 90 degrees apart, and the even-numbered panels being likewise stacked in a straight column of receding length. The resulting pyramidal structure comprises four deeply inverted corners. Using similar setups, other pyramidal structures can be assembled that exhibit six or eight inverted corners.

Upside-Down Shapes. Many artificial tree owners prefer the appearance of inverted Christmas trees. The display accommodates such preferences: users simply follow any of the instructions for formations above but begin layering with the shortest hollow-chambered panel **37-*n* instead of the longest hollow-chambered panel 37-1. To facilitate these inversions, the LED controller 25** can be set so that the brightest lighting is directed to the location of the longest hollow-chambered panels.

Symmetrical Hourglasses. This formation is similar to the shape shown in FIG. 5, except that it exhibits two conical spirals: the lower one being right-side up and the higher one being upside-down. To arrange the bottom spiral, users slide the longest panel, 37-1, down the center post until it rests on top of and parallel with the platform 29. Users then slide the next odd-numbered panel, 37-3, down the center post and place the panel's outer left edge so that it barely overlaps the right outer edge of panel 37-1. This process is repeated in an ascending numerical sequence for all remaining hollow-chambered panels that bear odd numbers. To arrange the inverted top spiral, users slide the highest even-numbered panel down the center post until it rests on top of and parallel with the last-placed odd-numbered panel. Then users slide the next highest even-numbered panel down the center post and place its outer left edge so that it barely overlaps the right outer edge of the last-placed panel. This process is repeated in a descending numerical sequence for all remaining hollow-chambered panels. To finish, individual hollow-chambered panels can be adjusted to the left or right to close any gaps. In some instances, LED animations can be programmed in which horizontal bands of colored light, representing sand, slowly trickle down from the top of the hourglass and accumulate below.

Festivus Poles. Some users might prefer to completely forgo the use of any hollow-chambered panels, as shown in FIG. 2. In such a configuration, the display presents itself as an unadorned but illuminated center post 20 that is appropriate for use during the Seinfeld-inspired holiday known as "Festivus." This scaled-down configuration offers consumers additional savings because it avoids the costs of a full decorative panel assembly 36. If desired, hollow tubes of translucent plastic can be mounted over the center post 20 to diffuse the LED lights.

The display accommodates toppers of various designs: stars for Christmas 38; hearts for Valentine's Day; jack-o-lanterns for Halloween; etc. In some instances, a plurality of LEDs can be left exposed above the topmost hollow-chambered panels and used to light integrated translucent display toppers. These integrated toppers possess hollow interiors that fit snugly over the apex of the center post and the exposed plurality of LEDs. As the LED strips 24 flash colors and animations, the integrated toppers appear to illuminate in coordination with the decorative panel assembly 36. In other instances, the highest positioned LEDs are covered by the topmost hollow-chambered panels. The upper terminus of the LED strip can be linked to a topper via wires and plugs or the like that relay the strips' electrical current and data stream to the topper's onboard LED lights. In still yet other instances, the toppers 38 can shine independently of the display. Such toppers can be powered through various means, including batteries located within the topper itself or wires with plugs or the like that transit down the center post's hollow interior and exit to connect with an external power source through holes cut into the center post 20 and base sleeve 21. It should be understood that the plugs connecting to or from the topper can be any suitable type of plug or the like, such as, for example, barrel plugs, 2-pin plugs, 3-pin plugs, 4-pin plugs, bullet connectors, or the like, or combinations thereof.

With its varied lighting effects, the display provides a complete ornamental arrangement that requires no further decoration. This avoids the expense of acquiring the various accessories that typically adorn other artificial trees such as light strings, garlands, hanging ornaments, and the like. Nevertheless, some users might desire extra trimmings. The display accommodates this. In some instances, lightweight ornaments can be perched upon the topside of individual hollow-chambered panels **37-1-37-*n*** and secured, if desired, with removeable double-sided tape. Additionally, in some instances lightweight ornaments can be hung from panel ends and sides using small fasteners of various types, including but not limited to miniature alligator clips.

In the instance of taller displays, the center post 20 can comprise detachable multiple segments in order to save on shipping costs, warehousing requirements, and home storage space. These segments can be joined together with suitable connectors of various designs, which, as shown in the examples depicted in FIGS. 1, 9 through 15, include but are not limited to: (1) internal couplings 42; (2) flanged internal couplings 47; (3) screw-in joints 52; (4) button snap locks 55; and (5) telescopic segments. The type of segment connector used in any given instance will depend in part upon the segments' material composition and dimensions. The type of segment connector used will also depend in part upon the size of the male/female plugs 46 that link the separated lengths of LED strips 24. No matter which type of segment connector is used, it leaves sufficient space for the unimpeded transit of the hollow-chambered panels **37-1-37-*n* over the affixed LED strips 24. The segment connector also minimizes any vertical gaps between joined LED strips 24. Further, any segment connector used can accommodate access to hollow spaces that house wires and plugs. It should be understood that the plugs connecting to or from the LED strips 24** can be any suitable type of plug or the like, such as, for example, barrel plugs, 3-pin plugs, 4-pin plugs, bullet connectors, or the like, or combinations thereof.

Internal Couplings. In the instances shown in FIGS. 9 through 11, the lower segment 39 and the upper segment 40 can be joined with an internal coupling 42 that, once installed, is completely overlapped by the lower and upper segments 39-40. To ensure a snug fit, the outside diameter of the internal coupling 42 closely approximates the inside diameters of the lower and upper segments 39-40. The lower half of the internal coupling 42 is permanently mounted to the uppermost interior of the lower segment 39. At the top of the lower segment 39, the affixed LED strip 24 merges into a set of unaffixed of wires 45. In the instances shown in FIGS. 9 through 11, these wires drop through a slot 41 cut into the rim of the lower segment 39 and through a matching slot 43 in the internal coupling 42 to reach the coupling's hollow interior. Using this hollow space as a conduit, the wires 45 pass through the top of the internal coupling 42 where, after a short distance, they terminate into a male/female plug 46. The bottom of the upper segment 40 begins with a corresponding male/female plug 46 that is attached to its own set of unaffixed wires 45. These wires travel a short distance until they enter the hollow interior located at bottom of the upper segment 40. Once inside, the wires 45 pass through a slot 41 cut into the rim of the upper segment 40. At this point, the unattached wires 45 merge into the upper segment's affixed LED strip 24, which begins its upward spiral along the outer surface of the upper segment 40. When the male/female plugs 46 between post segments have been connected, they can be tucked inside the hollow interior of the upper segment 40. The lower and upper segments 39-40 are then joined together so that the slot 41 that intersects the rim of the upper segment overlaps a matching slot 44 in the internal coupling 42. Other post segments, if any, can be connected using this same approach.

Figure 12:
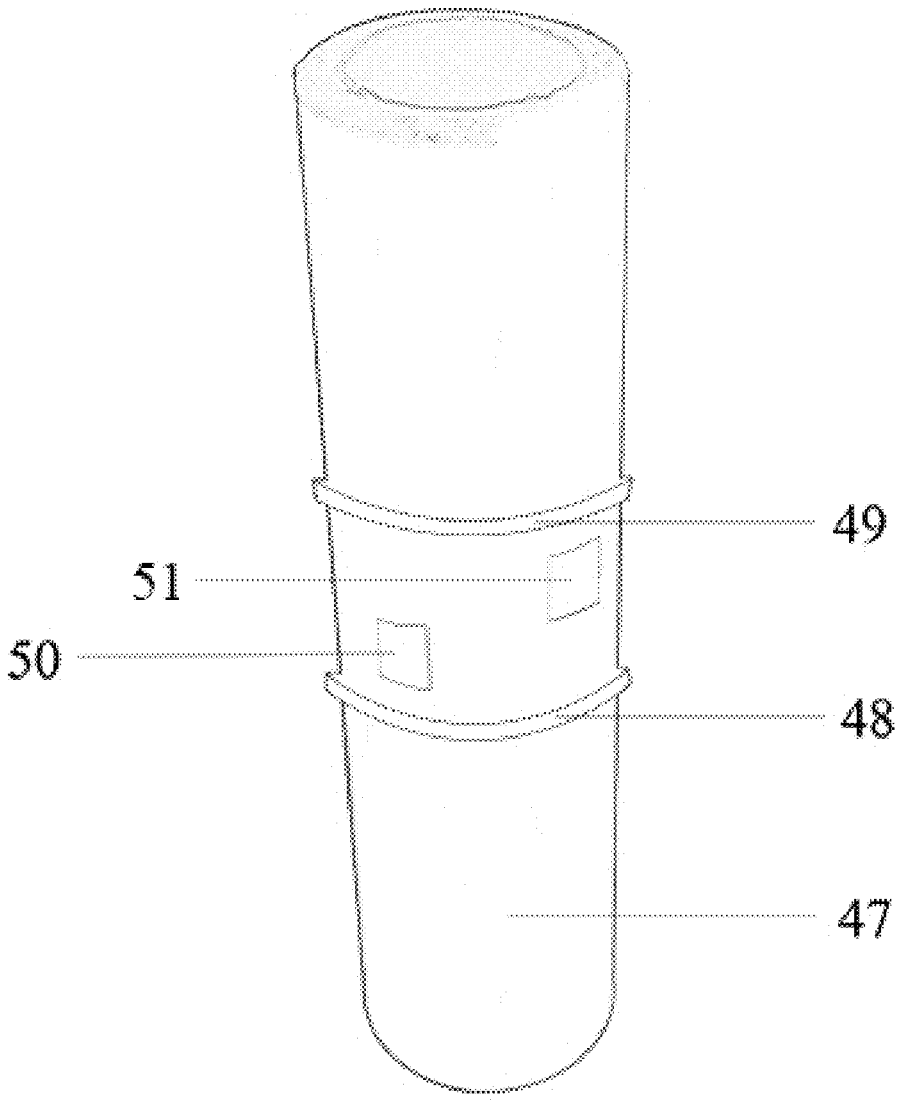
FIG. 12 shows an example flanged internal coupling of a decorative display.

Flanged Internal Couplings. This type of connector is shown in FIG. 12. The outside diameter of this internal coupling 47 closely approximates the inside diameters of the upper and lower segments 39-40 except for two integrated flanges 48-49 that encircle the coupling's outer perimeter and provide a flat and level perch for the rim of each segment. The distance the flanges 48-49 extend from the outer surface of the coupling 47 approximates the outer diameter of the lower and upper segments 39-40. The lower half of the internal coupling 47 can be permanently mounted to the interior of the lower segment 39. The upper segment 40 slides over the top of the coupling 47 until it rests atop the coupling's upper flange 49. Once the segments have thus been joined, a middle section of the coupling 47 remains exposed to view between the post segments 39-40. The set of wires 45 emerging from the lower segment's LED strips 24 can be wrapped upwards along this exposed middle section and, likewise, the set of wires 45 emerging from the upper segment's LED strips 24 can be wrapped downwards. Compatible plugs 46 located at each wire set's terminus can then be snapped together to assure the uninterrupted transmission of power and data along the LED strips 24. In some instances, the wrapping of wires and plugs can be secured in place with a close-fitting plastic tube (not shown). Other post segments, if any, can be connected using this same approach. In some instances, the exposed area of the coupling can include an upper entry hole 50 and lower entry hole 51 that will provide an interior housing where the two compatible plugs 46 can be inserted and connected without protruding beyond the outside diameter of the center post 20 and LED strips 24.

Figure 13:
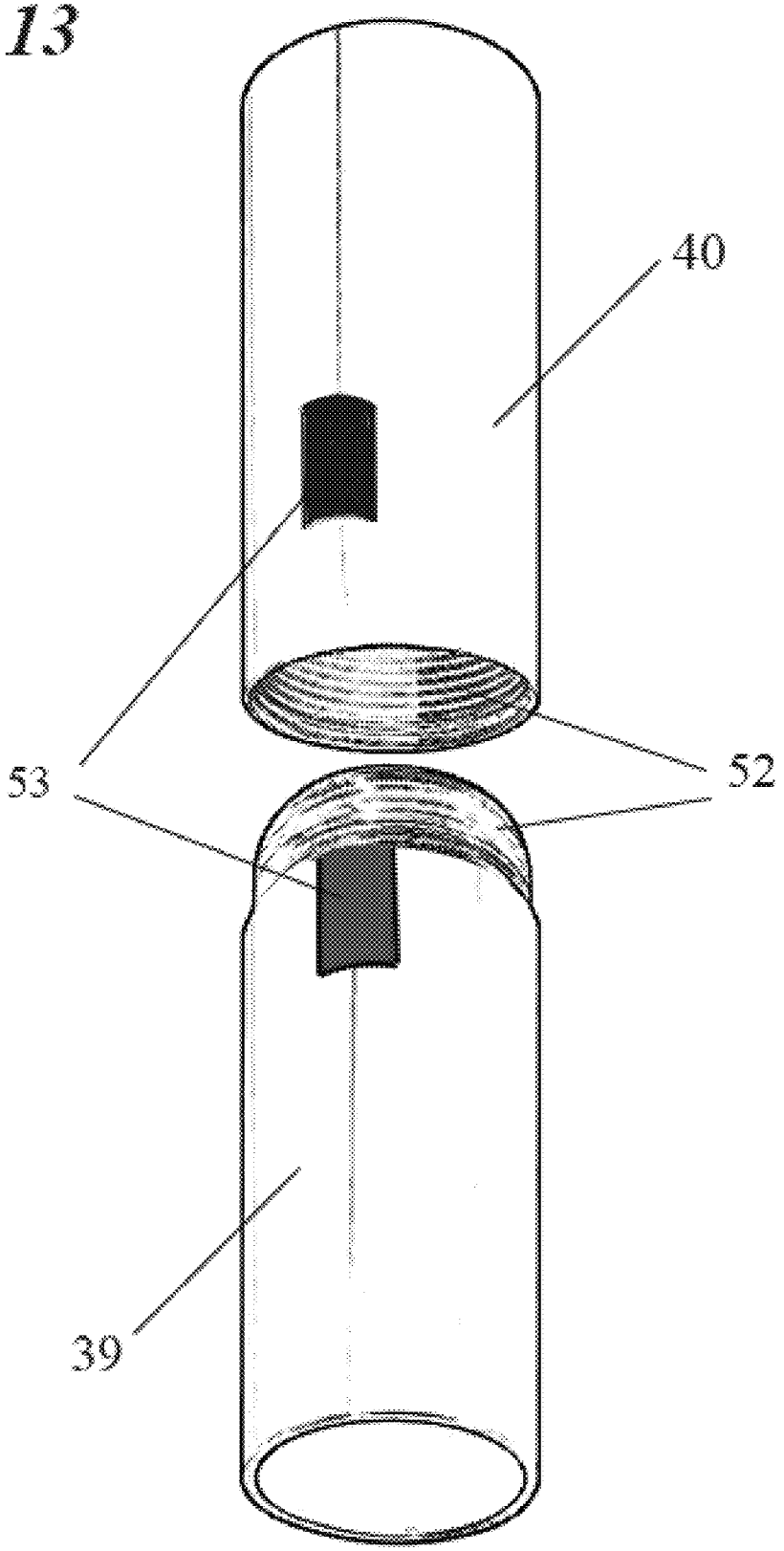
FIG. 13 shows an example screw-in joint for two post segments of a decorative display.

Screw-In Joints. As shown in FIG. 13, the connectors consist of threads 52 located at the tips of the lower and upper segments 39-40. In the instance shown in FIG. 13, each segment includes slots 53 that allow connective wires and plugs to transit from the segment's outer surface to its hollow interior and, after that, past each segment's open end. Once the plugs 46 have been connected, they can be tucked inside the hollow interior of the upper segment 40. The threads 52 can then be twisted together to join the segments. Other post segments, if any, can be connected using this same approach.

Figure 14:
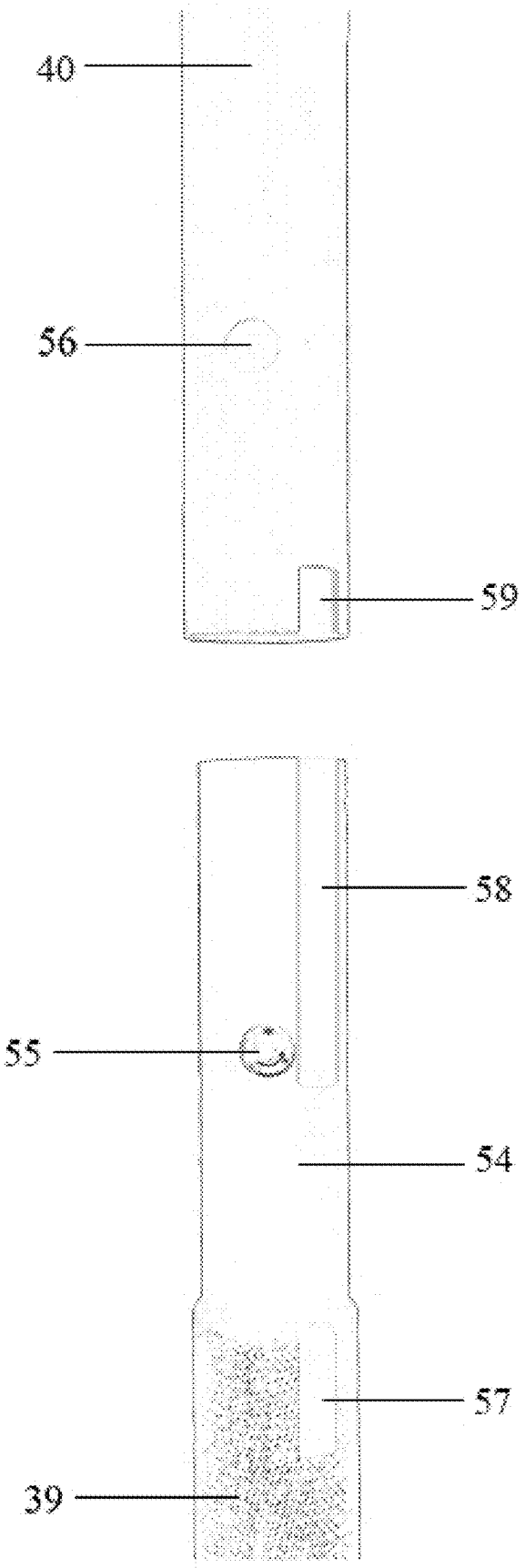
FIG. 14 shows an example button snap lock for two post segments of a decorative display.
Figure 15:
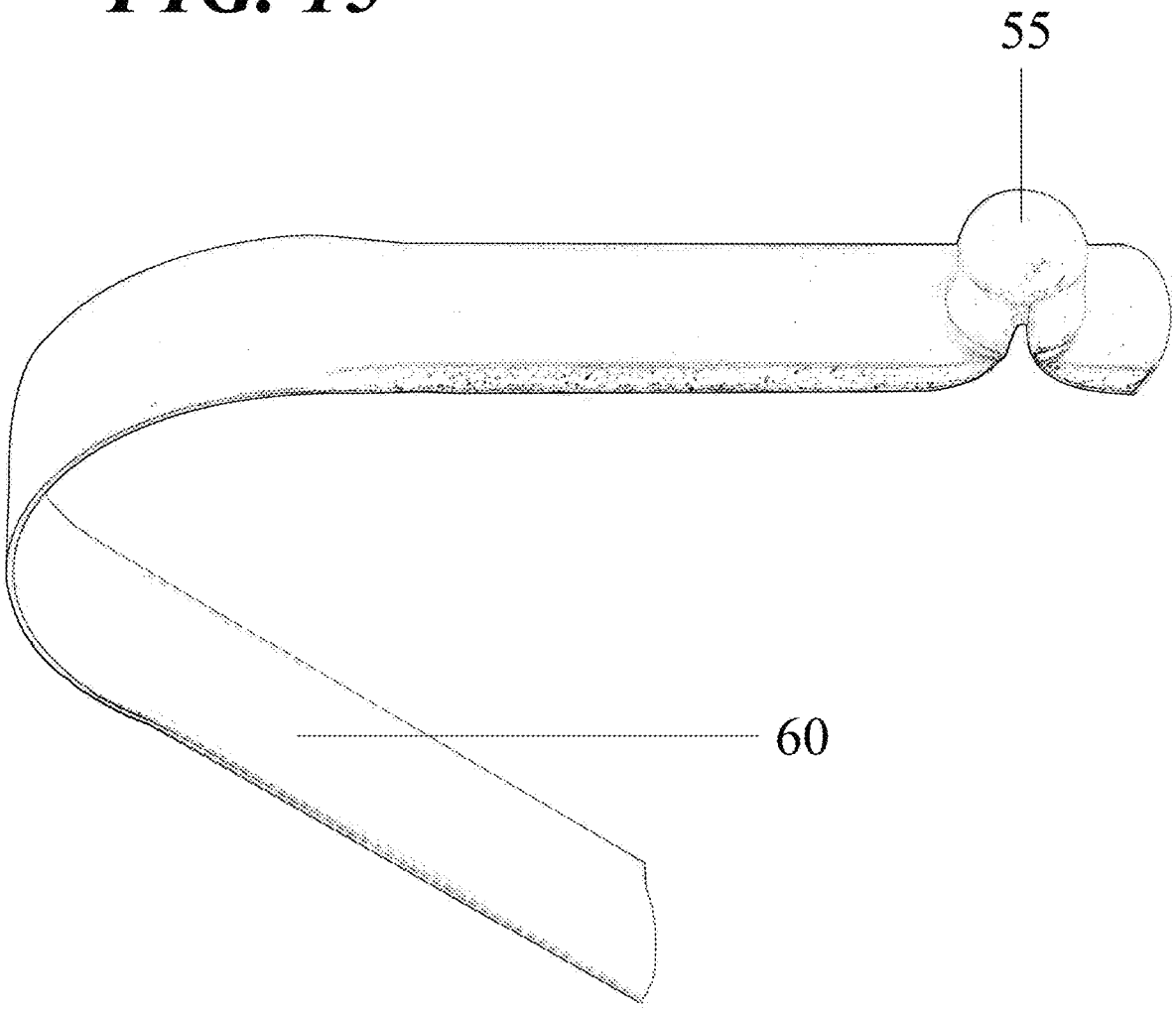
FIG. 15 shows a detail of an example spring for a button snap lock of a decorative display.

Button Snap Locks. As shown in FIGS. 14 and 15, the lower segment 39 features a tapered end 54 with a spring-loaded 60 button 55 that is wedged into the interior of the lower segment 39 so that the button 55 protrudes through a tight-fitting hole. When the lower segment's tapered end 54 slides far enough into the upper segment 40, the button 55 snaps into the upper segment's receiving hole 56. This action locks both segments together until such time as the button 55 is depressed and the segments are pulled apart. Connective wires 45 and plugs 46 for the LED strips 24 can transit through three aligned slots 57-59 that provide access to the segments' hollow interiors. A first slot 57 is located on the lower segment 39 immediately below the start of the tapered section 54. This slot is located to the side of the spring-loaded button 55 so as not to impede the button's inner spring 60. A second slot 58, which is located directly above the first slot 57, runs from an alignment slightly behind the button 55 through the top rim of the lower segment 39. A third slot 59, which aligns with the first two slots 57-58, cuts through the bottom rim of the upper segment 40. Once the compatible plugs 46 have been connected, the wires and plugs can be tucked inside the hollow interior of the upper segment 40. Once the second slot 58 has been lined up with the third slot 59, the two segments can be slid together without pinching any wires. Other post segments, if any, can be connected using this same approach.

Telescopic Segments. The interior diameter of the lower segment 39 can be sized so as to accept insertion of the upper segment 40. This mirrors somewhat the arrangement depicted in FIG. 1, in which the base sleeve 21 accepts insertion of the center post 20. In some instances, thin wall pipe or tube can be used for the upper and lower segments to limit the disparity in their outside diameters. In some examples of telescopic segments, the lower segment 39 can include a stop to limit the distance of the upper segment's insertion. This stop can take any of several forms, including but not limited to a bolt that traverses through the interior of the lower segment 39 and is attached at the lower segment's outer surface using a nut, rivet, or other fastener. In some examples, a hole can be bored through the surface of the upper segment 40 to house any connective wires or plugs from the two segments' connected LED strips 24. Other post segments, if any, can be connected using the same approach.

In the instance of the tallest displays, various methods, including but not limited to the following, can be used separately or in combination to deliver light sufficient to illuminate the longest hollow-chambered panels. First, as previously mentioned, the LED strips 24 can be wrapped into a tighter spiral. Second, the outside diameter of the lowest segment of the center post 20 can be increased, thereby increasing the number of LEDs per vertical linear inch along that length of the center post 20. Third, in a modification of the panel shown in FIG. 6, the widths of the longest hollow-chambered panels can be narrowed at their midsections to allow the escape of more ambient light.

In some instances, the center post 20 can include an integrated nondetachable version of the base sleeve 21. Like the base sleeve 21, this integrated sleeve expands the center post's diameter at its lower extremity and creates a level rim that encircles the outer perimeter of the center post 20. This rim provides a stable perch for the platform 29 and/or the decorative panel assembly 36.

In some instances, the center post 20 with or without base sleeve 29 can consist of various cross-sectional shapes other than circles, including but not limited to circular segments, ovals, partial ovals, triangles, squares, rectangles, parallelograms, and polygons. In such instances, the base sleeve 29 can possess a cross-sectional exterior shape that differs from the center post 20.

In some instances, the center post 20 with or without the base sleeve 29 can be supported by a base that includes an integrated electric motor. When operated, the motor rotates the decorative panel assembly 36 in a clockwise or counterclockwise direction.

In some instances, any spans of wires that transit through slots and holes in the center post 20, base sleeve 21, lower segment 39, upper segment 40, or any segment connectors

41, 47, 52, & 55 can be reinforced by protective coverings of shrink wrap or flexible tubing.

In some instances, a plurality of LED strips 24 can be affixed to the center post 20 in a pattern of straight lines that vertically ascend the post's outer surface (hereinafter referred to collectively as the "parallel strips"). The parallel strips ascend the center post to approximately the same height at or near the post's apex. As affixed to the center post 20, the parallel strips can feature staggered starting points that vary by a vertical distance approximately equal to the height of an individual LED. Such staggering helps to blend brightness levels along the length of the center post 20. At its lowest point on the center post 20, each affixed parallel strip transitions into a set of unaffixed wires. Each wire in the set performs a function relating to the operation of the LED strips 24 such as data in, ground, power, or other operational function. After a short distance has been spanned away from the center post 20, the wires from each of the parallel strips that perform the same function can be combined together through suitable means, including but not limited to soldered connections, male/female plugs, or connections accomplished in a junction box. Once combined, the wires can be linked into the LED controller 25. The LED controller 25 can be configured to assure the coordinated presentation of lighting effects among the parallel strips. In instances of taller displays, the parallel strips can ascend to the same approximate height at or near the apex of each center post segment 39-40. Parallel strips on the lower segment 39 can be joined to their counterparts on the upper segment 40 using suitable connective wires and plugs. In some instances of taller displays, to deliver sufficient light to illuminate the longest hollow-chambered panels, one or more lower center post segments can host a greater number of parallel strips. It should be understood that any plugs connecting to or from the parallel strips can be any suitable type of plug or the like, such as, for example, barrel plugs, 3-pin plugs, 4-pin plugs, bullet connectors, or the like, or combinations thereof 40. In some instances, the set of unaffixed wires 23 that connect the bottom of the LED strips 24 to the LED controller 25 can transit through a slot in the center post 20 to reach the post's hollow interior. From that point the wires can travel down the center post's interior to a point near its lower terminus. Here, the wires can exit via holes through the center post 20 and, if included, the base sleeve 21. Alternatively, the wires can exit through a slot cut into the bottom edge of the center post 20 and, if included, a corresponding slot cut into the bottom edge of the base sleeve 21. After exiting the center post 20, the wires terminate in a male/female plug 32. This plug connects to a corresponding plug 32 and connective wires that link to the LED controller 25.

In some instances, the hollow-chambered panels 37-1-37-*n* can comprise two or more dimensions of thickness (in this context, thickness is defined as a panel's vertical height as measured when the panel is mounted on the center post 20). In some instances, the longest panels would be the thickest in dimension and the shortest panels would be the thinnest in dimension.

In some instances, a clear or frosted sleeve may be inserted between the topmost hollow-chambered panel 37-*n* and the bottommost part of the display's topper 38.

The elements of the decorative display described herein comprise components that may be sold in the form of a kit to be assembled by consumers.

In various aspects, system elements, method steps, or examples described throughout this disclosure (such as the LED controller, or components thereof, for example) may be implemented on one or more computer systems, field programmable gate array (FPGA), application specific integrated circuit (ASIC) or similar devices comprising hardware executing code to realize those elements, processes, or examples, said code stored on a non-transient data storage device. These devices include or function with software programs, firmware, or other computer readable instructions for carrying out various methods, process tasks, calculations, and control functions, used in a distributed antenna system.

These instructions are typically stored on any appropriate computer readable medium used for storage of computer readable instructions or data structures. The computer readable medium can be implemented as any available media that can be accessed by a general purpose or special purpose computer or processor, or any programmable logic device. Suitable processor-readable media may include storage or memory media such as magnetic or optical media. For example, storage or memory media may include conventional hard disks, Compact Disk-Read Only Memory (CD-ROM), volatile or non-volatile media such as Random Access Memory (RAM) (including, but not limited to, Synchronous Dynamic Random Access Memory (SDRAM), Double Data Rate (DDR) RAM, RAMBUS Dynamic RAM (RDRAM), Static RAM (SRAM), etc.), Read Only Memory (ROM), Electrically Erasable Programmable ROM (EEPROM), and flash memory, etc. Suitable processor-readable media may also include transmission media such as electrical, electromagnetic, or digital signals, conveyed via a communication medium such as a network and/or a wireless link.

The methods and techniques described here may be implemented in digital electronic circuitry, or with a programmable processor (for example, a special-purpose processor or a general-purpose processor such as a computer) firmware, software, or in combinations of them. Apparatus embodying these techniques may include appropriate input and output devices, a programmable processor, and a storage medium tangibly embodying program instructions for execution by the programmable processor. A process embodying these techniques may be performed by a programmable processor executing a program of instructions to perform desired functions by operating on input data and generating appropriate output. The techniques may advantageously be implemented in one or more programs that are executable on a programmable system including at least one programmable processor coupled to receive data and instructions from, and to transmit data and instructions to, a data storage system, at least one input device, and at least one output device. Generally, a processor will receive instructions and data from a read-only memory and/or a random-access memory. Storage devices suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and DVD disks. Any of the foregoing may be supplemented by, or incorporated in, specially designed application-specific integrated circuits (ASICs).

A number of embodiments of the invention defined by the following claims have been described. Nevertheless, it will be understood that various modifications to the described embodiments may be made without departing from the spirit and scope of the claimed invention. Accordingly, other embodiments are within the scope of the following claims.

I claim:

1. An illuminated decorative display, comprising:

a center post;

an at least one LED strip affixed to an outer surface of the center post in a pattern configured to shine light in outward directions along a length of the center post; and a plurality of hollow-chambered panel members, wherein each of the hollow-chambered panel members is translucent, wherein each of the hollow-chambered panel members comprises within its interior an at least one cavity demarcated by an at least one inner support that is sandwiched between an at least one pairing of flat sheets, wherein each of the hollow-chambered panel members comprises a hole that passes through the at least one pairing of flat sheets, wherein each of the hollow-chambered panel members is mounted through the hole over the center post and the at least one LED strip, and wherein each of the hollow-chambered panel members differs in length from at least one other member of the plurality of hollow-chambered panel members.

2. The illuminated decorative display of claim 1, wherein each member of a subset of the plurality of hollow-chambered panel members, including but not limited to the at least one member of the plurality that is longest in length, has associated therewith a set of four lengthwise dimensions measured along a set of four outer edges, and wherein at least one outer edge within the set of four outer edges comprises a curved contour shape.

3. The illuminated decorative display of claim 1, wherein each member of the plurality of hollow-chambered panel members is made of corrugated plastic comprising at least two nonsolid faces that each expose to view a portion of the interior of the hollow-chambered panel member.

4. The illuminated decorative display of claim 1, wherein each of the plurality of hollow-chambered panel members comprises a plurality of outer surfaces, and wherein at least one of the outer surfaces of the plurality of outer surfaces comprises an imprinted ordinal number that signifies the length of the hollow-chambered panel member relative to other members of the plurality of hollow-chambered panel members for facilitating the arrangement of the decorative display into different shapes.

5. The illuminated decorative display of claim 1, wherein the plurality of hollow-chambered panel members comprises at least two hollow-chambered panel members of different widths.

6. The illuminated decorative display of claim 1, wherein the plurality of hollow-chambered panel members comprises at least two hollow-chambered panel members of different thicknesses.

7. The illuminated decorative display of claim 1, wherein the center post comprises a hollow interior.

8. The illuminated decorative display of claim 7, wherein the center post comprises a plurality of post segments, each post segment of the plurality of post segments being configured to detachably attach to an adjacent post segment, each post segment of the plurality of post segments having an LED strip affixed to the outer surface of the post segment with a connecting means for connecting to other LED strips, each post segment of the plurality of post segments having at least one slot that opens the outer surface of the post segment to the hollow interior for facilitating the attachment of the adjacent post segment without compressing the connecting means for connecting to other LED strips.

9. The illuminated decorative display of claim 1, wherein the at least one LED strip affixed to the outer surface of the center post comprises the shape of a looping helix that begins at a point above the base of the center post and winds upwards around the perimeter of the center post until it terminates at a point at or near the apex of the center post.

10. The illuminated decorative display of claim 9, wherein the looping helix comprises a plurality of complete loops that wind upwards around the perimeter of the center post, wherein each complete loop except the topmost loop has associated therewith a vertical distance measured from the top edge of the lower complete loop to the bottom edge of the adjacent upper complete loop, and wherein the vertical distance is varied along different portions of the center post for modulating the amount of light shining in outward directions along different portions of the center post.

11. The illuminated decorative display of claim 1, wherein the at least one LED strip comprises a plurality of LED strips vertically affixed to the outer surface of the center post in parallel relation to one another, the plurality of LED strips vertically affixed to the center post beginning at a point above the bottom of the center post and terminating at a point at or near the apex of the center post.

12. The illuminated decorative display of claim 11, wherein the plurality of LED strips vertically affixed to the outer surface of the center post in parallel relation to one another is varied in number along different portions of the center post for modulating the amount of light shining in outward directions along different portions of the center post.

13. The illuminated decorative display of claim 1, further comprising an LED controller that is connected by an at least one wire to the at least one LED strip and is operatively controlled by a signaling device that relays instructions to the LED controller regarding lighting effects for the at least one LED strip.

14. The illuminated decorative display of claim 13, wherein the signaling device is connected to the LED controller by an at least one wire.

15. The illuminated decorative display of claim 13, wherein the signaling device is connected wirelessly to the LED controller.

16. The illuminated decorative display of claim 13, further comprising an at least one external power supply that is electrically connected by an at least one wire to the at least one LED strip and the LED controller.

17. The illuminated decorative display of claim 16, further comprising a base sleeve that covers the center post at its lowest extremity, the base sleeve having a top rim that surrounds at least a part of the perimeter of the center post, the base sleeve having an outer surface that contains at least one opening to the hollow interior of the base sleeve for facilitating passage and storage of an at least one wire that connects the at least one LED strip to the LED controller and the external power supply.

18. The illuminated decorative display of claim 17, further comprising a platform having an aperture that passes through the center of the platform, the platform being capable of light transmission, the platform being mounted through the aperture over the at least one LED strip affixed to the outer surface of the center post, the platform being positioned on the top rim of the base sleeve.

19. The illuminated decorative display of claim 1, further comprising a top ornament with an opening at its base, the top ornament being translucent, the top ornament being hollow, the top ornament being mounted over an upper part of the at least one LED strip affixed to the center post that remains uncovered after each of the plurality of hollow-chambered panel members has been mounted over the center post.

20. A kit for assembling an illuminated decorative display, which comprises:

a plurality of hollow-chambered panel members, each member of the plurality of hollow-chambered panel members being translucent, each member of the plurality of hollow-chambered panel members having a hole therethrough, each member of the plurality of hollow-chambered panel members having a length that differs from the length of at least one other member of the plurality;

a plurality of post segments with hollow interiors, each post segment being configured to detachably attach to an adjacent post segment to form part of a center post, each post segment having an outer surface, each post segment having an LED strip affixed to the outer surface, each LED strip having a connecting means for connecting to the LED strip affixed to the adjacent post segment, each post segment having an at least one slot that accesses the hollow interior, the plurality of post segments having associated therewith a lowest-positioned post segment;

a base sleeve with a top rim that surrounds at least a part of the perimeter of the lowest-positioned post segment, the base sleeve having an outer surface that has at least one opening for an at least one wire that connects to the LED strip on the lowest-positioned post segment;

a platform made with a hole through its center that is large enough for the platform to pass over the top of the center post but not large enough for the platform to pass over the top rim of the base sleeve, the platform being capable of light transmission;

an LED controller having wires and plugs that connect to at least one of the LED strips located on the center post; and an at least one external power supply having wires that connect to the LED controller.

* * * * *